United States Patent [19]

Ward et al.

[11] 4,052,200

[45] Oct. 4, 1977

[54] PROCESS FOR DEBISMUTHISING LEAD

[75] Inventors: Denby Harcourt Ward; James Dixon Iley, both of Port Pirie, Australia

[73] Assignee: The Broken Hill Associated Smelters Proprietary Limited, Melbourne, Australia

[21] Appl. No.: 715,297

[22] Filed: Aug. 18, 1976

[30] Foreign Application Priority Data

Aug. 19, 1975 Australia ..... 2844/75

[51] Int. Cl.[2] ..... C22B 13/06

[52] U.S. Cl. ..... 75/78; 75/63

[58] Field of Search ..... 75/77, 78, 79, 63, 24, 75/93 DA

[56] References Cited

U.S. PATENT DOCUMENTS

| | | | |
|---|---|---|---|
| 1,687,188 | 10/1928 | Williams | 75/79 |
| 2,300,939 | 11/1942 | Lebedeff | 75/78 |

*Primary Examiner*—M. J. Andrews

*Attorney, Agent, or Firm*—Finnegan, Henderson, Farabow & Garrett

[57] ABSTRACT

A continuous process for debismuthising lead containing one or more alkaline earth metals or alloys thereof, comprising continuously adding thereto a reagent selected from the group consisting of antimony, arsenic and alloys containing antimony and/or arsenic, so as to form a crust/bullion mixture, continuously introducing the crust/bullion mixture into the lower separation zone of a separation vessel having an upper liquation zone and a lower separation zone, maintaining the temperature in the upper liquation zone between 330° and 480° C and maintaining the temperature in the lower separation zone between the freezing point of lead and 350° C, the average temperature in the upper liquation zone being at least 15° C higher than the average temperature in the lower separation zone, separating crust particles from the bullion in the lower separation zone, causing the crust particles to move upwardly in the vessel and the bullion to move downwardly in the vessel, separating entrained lead from the crust particles in the upper liquation zone so as to form enriched crusts, removing the enriched crusts continuously or intermittently from the upper surface of the material in the vessel, and withdrawing debismuthised product lead continuously from at or near the lower end of the lower separation zone.

20 Claims, 7 Drawing Figures

PROCESS FOR DEBISMUTHIZING LEAD

This invention relates to improvements in the debismuthising of lead, and refers especially to a continuous process for the removal of bismuth from lead and to apparatus for carrying out such process.

The Kroll-Betterton process (hereinafter referred to as the K-B process) for the debismuthising of lead has been known for many years, and the classic disclosure of the method appears in the Transactions of the AIME, 121, 1936, 205–225. The K-B process is defined for the purposes of this specification as a process for debismuthising lead comprising treatment of the bismuthcontaining lead with one or more alkaline earth metals. The alkaline earth metals may be added as such or as alloys with one another or as alloys with lead. If desired they may be electrolytically infused into the input lead stream. In the preferred form of the K-B process the molten lead is treated or alloyed with calcium and magnesium, with agitation, at a temperature in the region of 380° to 450° C, the lead alloy is then cooled to a temperature near the freezing point of lead, and the crusts formed on the surface of the lead are skimmed off or the lead is otherwise separated therefrom.

The term "crust" used in this specification refers to a suspension of particles of antimony-containing compounds (e.g. antimonides) or arsenic-containing compounds and bismuth-containing compounds (e.g. calcium and magnesium bismuthides) in metallic lead. The consistency of the suspension above the melting point of lead depends on the relative proportions of solid material and molten lead and varies from a paste-like consistency at high solid content to a free-running liquid when molten lead predominates. The particles are wetted by the lead and the crust normally has a metallic sheen.

The chemistry of the K-B process was discussed by Davey (Journal of Metals, 8, 1956, 341–350; Erzmetall, 10, 1957, 53–60). The latter papers give a basis for the calculation of the quantities of reagents, viz., calcium and magnesium metal, which must be alloyed with lead in order tht an insoluble bismuthide compound be precipitated out under carefully controlled temperature conditions. There appear to be two fundamental requirements, namely (a) that sufficient calcium and magnesium are present to saturate the lead metal, and (b) that sufficient additional reagent is supplied to form the hypothetical bismuth compound.

Traditionally, the K-B process has been carried out batch-wise. The reagents are stirred into the lead at an appropriate temperature, and the batch cooled slowly to a few degrees above the freezing point. It seems to be generally agreed that the bismuthides precipitate out at temperatures below 360° C.

A noteworthy advance in Kroll-Betterton (K-B) practice is the continuous version of the said process (using calcium and magnesium metal) in operation at the Hoboken plant of Metallurgie-Hoboken Overpelt. This is described in a paper by Leroy, Lenoir and Escoyez; AIME Symposium of Mining and Metallurgy of Lead and Zinc, 1970, Vol. II, 824–852.

Although the K-B process in theory appears to offer the opportunity of reducing the bismuth content of the product lead to as low as 0.002% by weight, in practice this can be achieved only at the expense of using uneconomically large quantities of reagent. Further, at these low bismuth concentrations, even a minute quantity of unremoved bismuth-containing precipitate can cause an unacceptable degree of bismuth contamination of the product lead. Accordingly, the possible practical level of bismuth removal is considered to be in the region of 0.004 to 0.01% bismuth in the product lead. Some plant operators consider even these levels to be uneconomic and use the K-B process to debismuthise lead only to about 0.02% bismuth.

Some lead smelters, including the works of the applicant at Port Pirie, South Australia, have traditionally produced and marketed lead containing about 0.005% bismuth, but it appears that the bismuth content of future ore supplies may be such that existing processes will not enable a bismuth content of about 0.005% in the product lead to be achieved. Moreover, it is believed that there will be an increased demand for lead having a lower bismuth content, e.g. lead containing about 0.001% bismuth or less. Consequently there is an increasing need for a more efficient and economic process for the debismuthising of lead, and it is an object of this invention to provide such a process. A further object is to provide a debismuthising process which may be operated continuously and with greater efficiency than existing batch processes.

The invention in one aspect relates to the use of antimony or arsenic or an alloy containing antimony and/or arsenic, for the debismuthising of lead which contains one or more alkaline earth metals or alloys thereof, in such a manner that the process may be carried out continuously and the bismuth content of the product lead may be reduced to a low value, e.g. to less than 0.002% or 0.001% by weight or in some cases to a value in the region of 0.0005%.

The use of metallic antimony or arsenic for debismuthising lead which had previously been debismuthised with calcium and magnesium, is referred to in U.S. Pat. Nos. 2,056,164 and 2,101,975. However, the process described in these patents, sometimes referred to as the "antimony variant" of the K-B process, has not been widely adopted or commercially successful. This is believed to be due to a number of factors, including the formation of unacceptably large quantities of antimonial crusts, which were in some cases as high as 40% of the input lead weight, and difficulty and hygiene hazards involved in subsequent treatment of the crust, and the failure of the process when used on a commercial scale to achieve the low bismuth contents of the product lead which the authors of the process had claimed to be achievable. It has been found, for example, that when treating large quantities of crusts containing calcium, magnesium and antimony, as are produced in the said prior process, the oxides of these metals which are formed by the oxidation treatment tend to form an emulsion with the metal, and the separation of these emulsified oxides is very tedious and difficult.

We have discovered surprisingly that these difficulties can be overcome and lead may be debismuthised to bismuth contents below 0.002% or 0.001% of the product lead, by a continuous process which according to one aspect of the invention comprises continuously subjecting lead containing one or more alkaline earth metals or alloys thereof (e.g. lead which has previously been subjected to the K-B process, and which contains residual alkaline earth metals) to treatment with a reagent selected from the group consisting of antimony, arsenic and alloys containing antimony and/or arsenic, the proportion of reagent to the lead being preferably between 0.02% and 0.25% by weight, and continuously, substantially continuously or intermittently separating the crusts containing alkaline earth metal, antimony and/or arsenic and bismuth from the debismuthised lead.

A feature of this form of the invention is that the quantity of crusts formed is relatively low, i.e. below 15%, preferably below 10%, by weight of the product lead, and the crusts formed are substantially prevented from accumulating and are separated from the debismuthised lead.

According to the invention, we provide a continuous process for debismuthising lead containing one or more alkaline earth metals or alloys thereof, which comprises continuously adding thereto a reagent selected from the group consisting of antimony, arsenic and alloys containing antimony and/or arsenic, so as to form a crust/bullion mixture, continuously treating the crust/bullion mixture in a separation vessel having an upper liquation zone and a lower separation zone, causing the crust particles to move upwardly in the vessel and the bullion to move downwardly in the vessel, the crust particles being separated from the bullion in the lower separation zone and entrained lead being separated from the crust particles in the upper liquation zone.

According to a preferred apsect of the invention, the crust/bullion mixture is introduced into the lower separation zone of the vessel and the separation of the crust particles from the debismuthised lead is effected mainly in the said lower separation zone of the vessel, such separation being due primarily to the difference between their specific gravity compared with that of lead, the temperature in the lower separation zone being maintained sufficiently low to minimize re-solution of bismuth-containing particles in the downflowing lead, and in the upper liquation zone the crusts are maintained at a temperature sufficient to facilitate the liquation of the entrained lead from the crusts and thus concentrate the crusts, the enriched crusts being removed from the surface of the material in the vessel.

Novel features of our invention, in one form, are (a) that the reagent is added continuously to the bullion stream at a temperature favourable to the incorporation of the bismuth into the solid phase (i.e. the crust particles), such temperature being as low as possible, i.e. as close to the freezing point of lead as practicable (b) that the crust/bullion mixture is treated in the lower separation zone of a two-zone separation/liquation vessel, in which zone the solid crust particles separate from the bullion and move upwardly in the vessel, the temperature in said lower separation zone being sufficiently low to substantially prevent re-solution of the bismuth-containing crust particles in the bullion, and (c) that the temperature in the upper liquation zone (which is preferably higher than that in the lower separation zone) enables maximum separation of entrained lead from the crust/particles passing upwardly through said zone, which results in the formation of a smaller quantity of crusts which contain a minimum of entrained lead, the said enriched crusts being removed from the upper surface of the material in the vessel.

Preferably, at least 95% (more preferably at least 99%) of the crust particles present in the crust/bullion mixture are separated therefrom in the lower separation zone; and preferably at least 85% (more preferably at least 90%) of the total input lead (as bullion and reagent alloy) is recovered as product lead; the said proportions being by weight.

The temperature in the lower separation zone is between the freezing point of the bullion (e.g. 318° to 327° C) and 350° C, preferably below 340° C, and is maintained as low as possible to ensure separation of crust particles from the bullion without re-solution of the crust particles in the bullion. The temperature in the upper or liquation zone (which is preferably at least 15° higher than that in the lower separation zone) is between 330° and 480° C, preferably between 370° and 410° C, and is most preferably about 380° C. The temperatures in the two zones are independently controlled.

The reagent may be added to the lead bullion, which contains an alkaline earth metal or metals (e.g. lead bullion which has previously been subjected to the K-B process and which contains calcium, magnesium, and bismuth), before it enters the lower separation zone. The reagent may be added to the lead bullion in another vessel which is separate from the separation vessel, or it may be added to the bullion in a mixing chamber located within the separation vessel, and the mixture of crust particles and bullion (hereinafter termed the crust/bullion mixture) then passes to the lower separation zone.

The invention also includes apparatus for debismuthising lead containing one or more alkaline earth metals or alloys thereof, which comprises a separation vessel having an upper liquation zone and a lower separation zone, means for independently controlling the temperature of each zone, means for adding a reagent selected from the group consisting of antimony, arsenic and alloys containing antimony and/or arsenic, to the input lead to form a crust/bullion mixture, means for introducing the crust/bullion mixture into the lower separation zone of the vessel, the crust particles being separated from the bullion in the lower separation zone and moving upwardly in the vessel, the entrained lead being separated from the crust particles in the upper liquation zone and moving downwardly in the vessel, means for removing the enriched crusts from the upper surface of the material in the vessel, and means for withdrawing debismuthised product lead from near the lower end of the lower separation zone.

In the ensuing description, except where otherwise stated, the term "reagent" is used for convenience to refer to a metal or alloy selected from the group consisting of antimony, arsenic and alloys containing antimony and/or arsenic.

The reagent may be added in solid or liquid form; but if arsenic per se is used it is added in solid form since on heating arsenic sublimes, the sublimination temperature of arsenic at atmospheric pressure being about 615° C. In the ensuing description any inference that arsenic is added in liquid form is to be excluded. When the reagent is added in solid form, an ingot of the reagent may be lowered into a bath of molten bullion at a controlled rate. When added in liquid form, the molten reagent (excluding arsenic) may be fed into a stream of molten bullion or may be fed into a vessel of molten bullion, in each case at a controlled rate. The rate of addition of the reagent is controlled according to the feed rate and composition of the lead bullion and other factors.

In one embodiment of the invention lead bullion which has been previously treated by the K-B process is introduced continuously together with the reagent, which may have been previously added to the bullion, to a reagent treatment kettle, which is preferably of uniform cylindrical shape and arranged vertically, at a point or points intermediate between the upper and lower ends thereof, e.g. at or near its mid-point, and at a temperature between 323° and 450° C, preferably between 330° and 350° C, and the bullion passes downwardly through a lower separation zone in the kettle at a temperature below 350° C, preferably between 325° and 340° C, the crust particles which separate from the bullion in the said lower separation zone passing upwardly in the kettle through an upper liquation zone therein at a temperature between 330° and 480° C, preferably between 370° and 410° C, most preferably about 380° C, the enriched crusts being continuously or intermittently removed from the kettle at or near its upper end, and the debismuthised lead being continuously removed from the kettle at or near its lower end.

The reagent may be added to the lead bullion in a separation mixing vessel, and the crust/bullion mixture comprising the lead bullion and the crust particles formed in said mixing vessel, is conveyed to the reagent treatment kettle by a suitable pipe or launder and is introduced thereinto as above described. Alternatively a steam of bullion and a stream of molten reagent may be introduced continuously and simultaneously into the mixing chamber of the kettle from suitable separate supply sources of these materials. The rate of addition of reagent is such as to give the required degree of debismuthising of the bullion. The proportion of reagent added to the lead is preferably between 0.02% and 0.25% of the lead by weight, and preferably is about 0.15%. The ratio of reagent to bismuth is preferably between 15:1 and 30:1 by weight, in order to achieve a bismuth content in the lead of less than 0.002% or 0.001% by weight.

A feature of the preferred form of the invention is that lead is continuously separated from the crust particles in the reagent treatment kettle or other vessel, the lead passing downwards through the lower separation zone and being continuously removed therefrom, the crust particles being separated from the bullion in the lower separation zone, and the crust particles passing upwardly through the upper liquation zone. Lead separates out from the crusts in the liquation zone as the solid crust particles move upwardly in said zone. The enriched crusts are continuously or intermittently removed from the upper end of the liquation zone. Continuous removal of debismuthised lead from the lower end of the lower separation zone, and the removal of enriched crusts from the upper end of the liquation zone, according to the method of this invention, enable the disadvantages of the prior batch processes to be substantially overcome.

The lead may be continuously removed from at or near the lower end of the kettle by means of a weir or siphon or other suitable means.

The enriched crusts may be removed from at or near the upper end of the kettle by any suitable means, and according to one preferred form of the invention the said crusts are moved or swept manually or mechanically from the upper end of the kettle into a circumferential channel or launder surrounding or partly surrounding the upper end of said kettle, and the said crusts are conveyed along said channel or launder, which may be provided with a downwardly sloping bottom, towards its outlet end, from which the crusts may be transferred by a suitable pipe or channel to a treatment vessel. Molten bullion from any suitable source having a temperature of, say, about 400° C, may be flowed along the channel or launder to convey the crusts, and a separate outlet for said bullion may be provided. The said billion may be recirculated.

Means may be provided to enable the level of the material in the kettle to be varied, e.g. by the use of a variable height outlet near the upper end of the kettle, so that removal of the crusts can be faciliated.

In a modification of the invention a mixing chamber is provided within the reagent treatment kettle, preferably centrally therewithin, and the bullion and reagent are introduced into this mixing chamber, which is suitably stirred or agitated and which is open-ended at its upper and lower ends and is provided with an insulating jacket. The said mixing chamber preferably extends downwardly from the upper end of the kettle to about its mid-point.

The residence time of the lead and crust particles in the kettle is not critical. Residence times for the lead flow between 10 minutes and 3 hours have been found satisfactory.

The downward velocity of lead in the separation zone of the reagent treatment kettle is of some importance, and since the separation efficiency is determined by the buoyancy of the crust particles, the downward velocity of the lead in said zone should not be so high that crust particles will be entrained in the downwardly flowing lead. The diameter of the kettle is preferably such that the downward velocity of the lead in the kettle is not greater than 1 meter per minute, preferably not greater than 0.5 meters per minute. The flow of lead is preferably in the laminar range, and if calculation shows that the lead flow would be in the turbulent range the diameter of the kettle should preferably be increased so that lead flow occurs under laminar flow conditions.

The depth of the lower separation zone is determined mainly by the need to overcome the effects of turbulence at the point of entry of the bullion into the kettle. It is considered that the ratio of depth:diameter of the lower separation zone should preferably be not less than 1:1. There is no upper limit other than that imposed by economic or engineering criteria. The depth of the upper liquation zone should be sufficient to ensure maximum separation of entrained lead from the crust particles during their upward passage through said zone. We have found a depth of the liquation zone of at least 0.1 meter, preferably at least 0.25 meter, to be satisfactory.

Other features of the invention will become apparent from the ensuing description of one embodiment of the invention which is illustrated in the accompanying drawings. The applicant is not to be regarded as limited to the said description or to the form of the invention as illustrated, since many modifications may be made therein within the scope of the invention.

Figure 7:
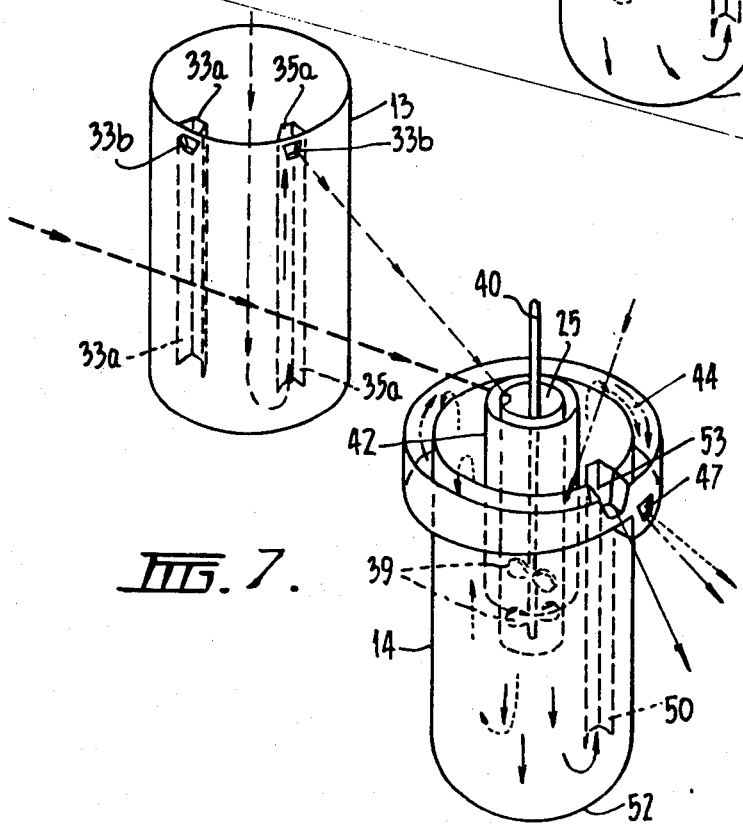
FIG. 7 is a schematic view similar to FIG. 4 showing a still further method of operating the process and apparatus of this invention (referred to herein as "Mode 4").

If arsenic per se is used as the reagent, it is added in solid form as shown in Mode 2 (FIG. 5) and is not used according to Mode 1 (FIG. 4), Mode 3 (FIG. 6) or Mode 4 (FIG. 7).

Figure 1:
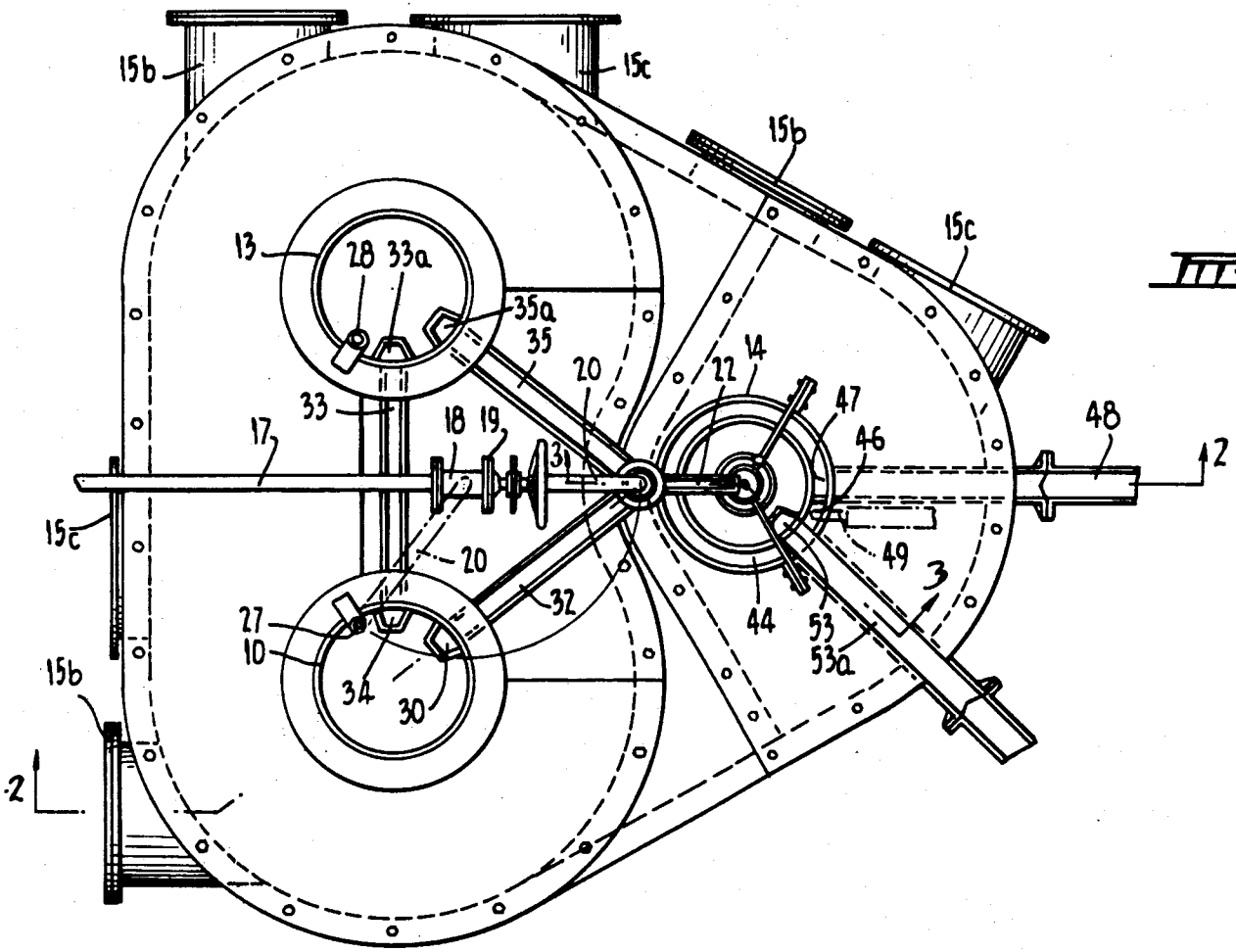
FIG. 1 is plan view of one form of pilot plant apparatus sued for the debismuthising of lead containing an alkaline earth metal or alloy thereof, e.g. lead which has been previously treated by the K-B process, the said apparatus being constructed and operated according to the present invention.
Figure 2:
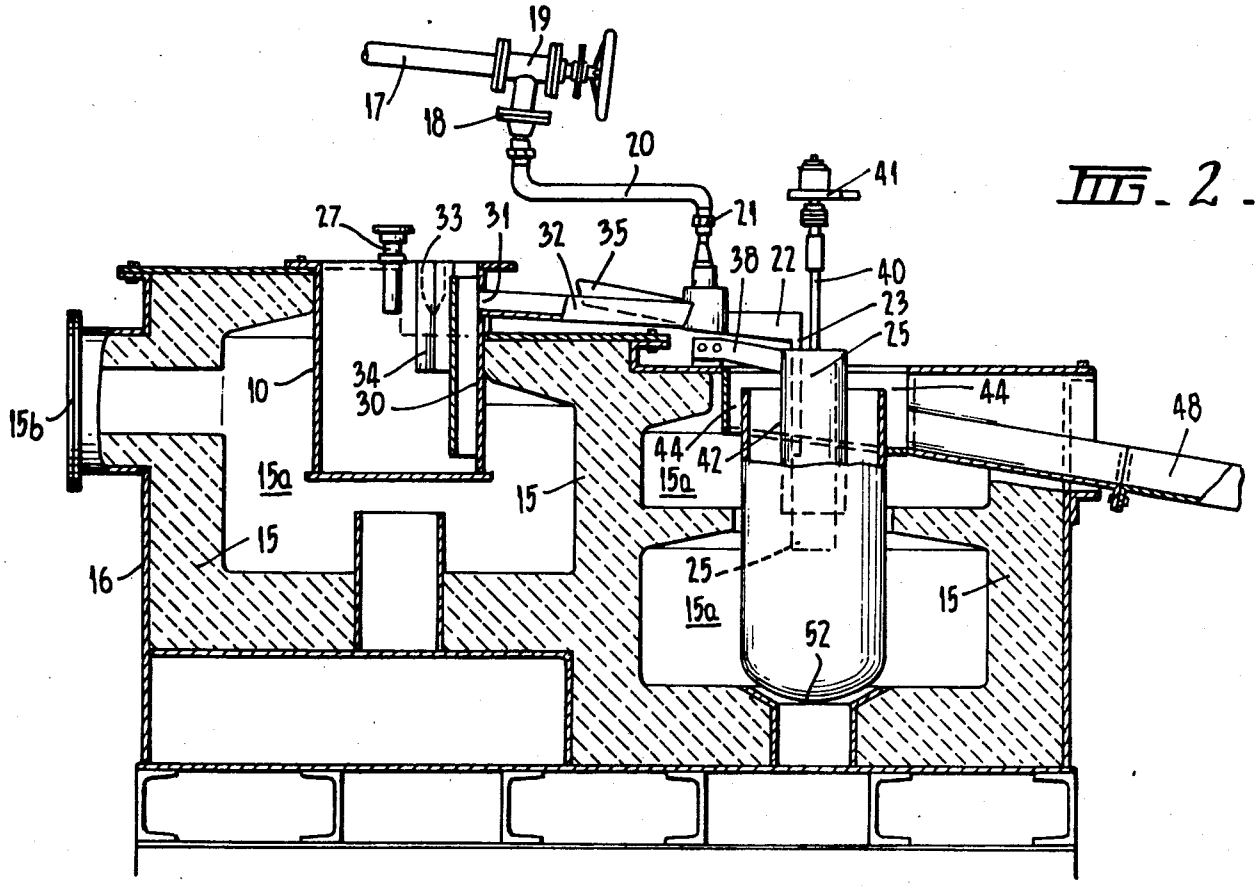
FIG. 2 is a view in sectional elevation taken on the line 2—2 of FIG. 1.
Figure 3:
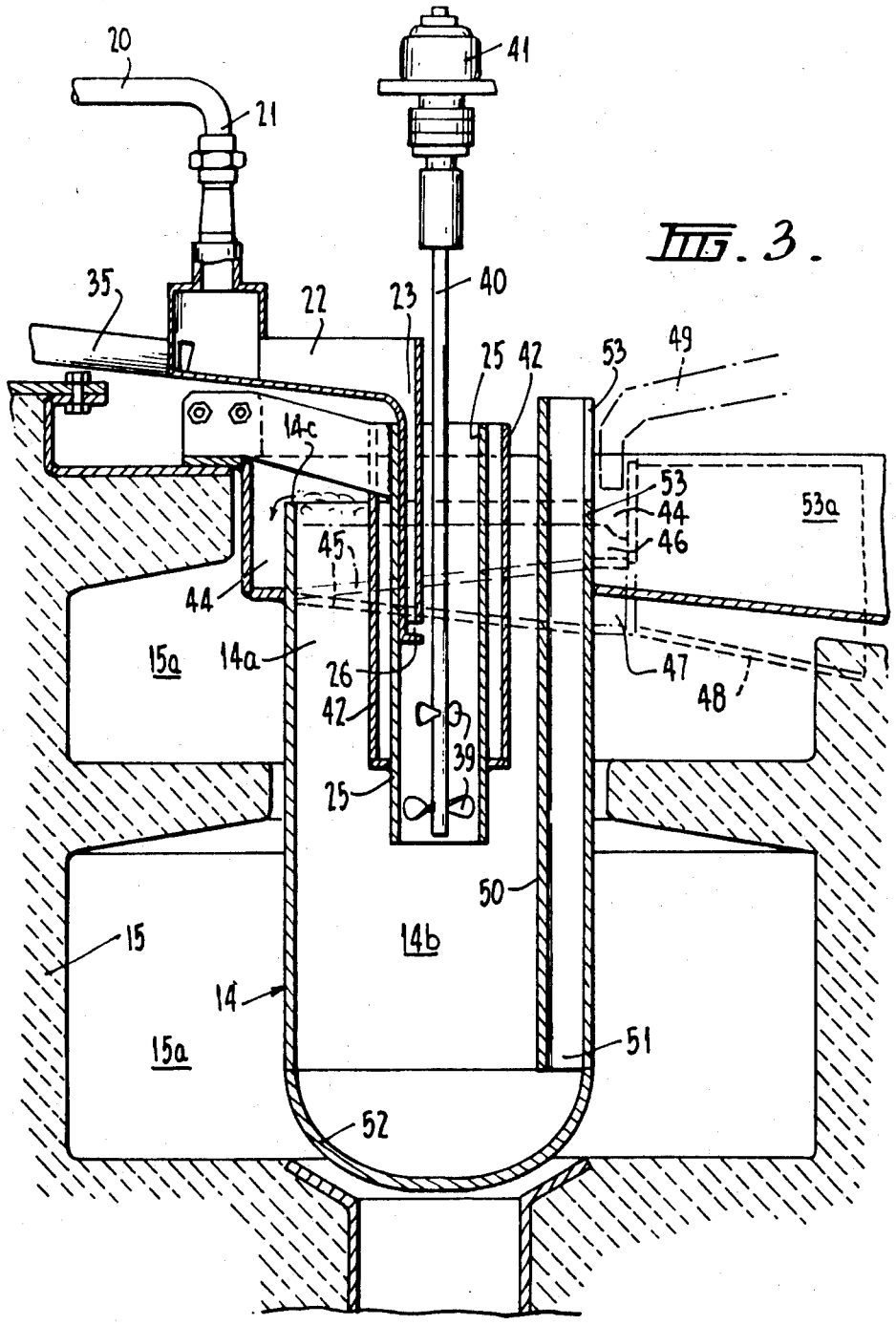
FIG. 3 is a view in sectional elevation taken on the line 3—3 of FIG. 1.

Referring to the drawings, and with particular reference to FIGS. 1 to 3, the reference numeral 10 indicates a cylindrical mixing pot or chamber which is provided with heating and cooling control facilities (not shown) and with a stirrer 11 (see FIG. 4) mounted on a driven vertical shaft 12.

A second cylindrical mixing pot 13 and a cylindrical reagent treatment kettle 14 are also provided, the kettle 14 being at a lower level than the mixing pots 10 and 13, and the pots 10 and 13 and the kettle 14 being arranged for convenience at the corners of a triangle and being surrounded by refractory insulating material 15 located within an outer metal casing 16. Burners (not shown) are directed into the combustion spaces 15*a* formed within the refractory 15. Burner ports are indicated at 15*b* and exhaust ports are indicated at 15*c*.

Impure lead bullion to be debismuthised which contains an alkaline earth metal or metals (e.g. lead which has been previously treated by the K-B process) is supplied to the apparatus through inlet pipe 17 and passes through control valve 19 and vertical pipe 18 to a distribution pipe 20 which can be swivelled about the axis of pipe 18 to any of three positions in each of which its outlet end 21 communicates with one of the mixing pots 10,13 or with the kettle 14 as hereinbefore described. In FIGS. 1, 2 and 3 the distribution pipe 20 is shown in full lines communicating with a sloping launder 22 which connects with the upper end of a vertical downpipe 23. The downpipe 23 extends downwardly within a cylindrical mixing chamber 25 which is mounted centrally in the upper part of the kettle 14, and an outlet opening 26 is formed in the lower end of the downpipe 23. In FIG. 1 the distribution pipe 20 is shown in dotted lines as communicating with an inlet opening 27 formed in the upper end of the mixing pot 10, and if desired the distribution pipe 20 may be swivelled to a position (not shown) in which it communicates with an inlet opening 28 formed in the upper end of mixing pot 13.

The mixing pot 10 is provided with a submerged weir 30 having a triangular notch 31 near its upper end which communicates with a sloping launder 32 which leads to the kettle 14 via launder 22. A submerged weir 33*a* is provided in the mixing pot 13 and communicates at its upper end via notch 33*b* with a sloping launder 33 which extends from mixing pot 13 to mixing pot 10 and connects with weir 34 therein.

A submerged weir 35*a* is also provided in the mixing pot 13 and communicates at its upper end via notch 35*b* with a sloping launder 35 which extends from mixing pot 13 to the kettle 14 via the launder 22.

The mixing chamber 25 is held in position centrally in the kettle 14 by bracket 38 and is open at its upper and lower ends. A double bladed stirrer 39 is mounted within the mixing chamber 25 and is provided with a vertical shaft 40 which is driven by power means 41. The mixing chamber 25 extends downwardly from the upper end of the kettle 14 to about its mid-point and is surrounded by an insulating jacket 42 which reduces heat transfer between the contents of the mixing chamber 25 and the contents of the kettle 14.

The kettle 14 is mounted in the refractory setting 15 in such a manner that the temperature of the upper part 14*a* and the temperature of the lower part 14*b* can each be controlled independently.

The kettle 14 is provided at its upper end with an externally mounted circumferential launder 44 the bottom 45 of which spirals or slopes downwardly from the inlet end 46 to the outlet end 47 where the launder 44 communicates with a sloping channel or launder 48 which leads to crust treatment apparatus (not shown). Lead bullion from any suitable source may be admitted to the inlet end 46 of the launder 44 through spout 49 and is caused to flow around the spiral launder 44 and to convey along said launder the enriched crusts which are transferred into said launder 44 from above the upper end of the kettle 14 as hereinafter described.

A siphon 50 is mounted at one side of and within the kettle 14 and communicates with the interior of the kettle 14 at its lower end 51. The lower closed end of the kettle 14 is shown at 52. The upper end 53 of the siphon 50 projects above the upper end of the kettle 14 (see FIG. 3) and is provided with an outlet notch 53 the height of which is adjustable. Refined or product lead passes upwardly in the siphon 50 and outwardly through the notch 53 and thence via launder 53*a* to subsequent treatment.

Figure 4:
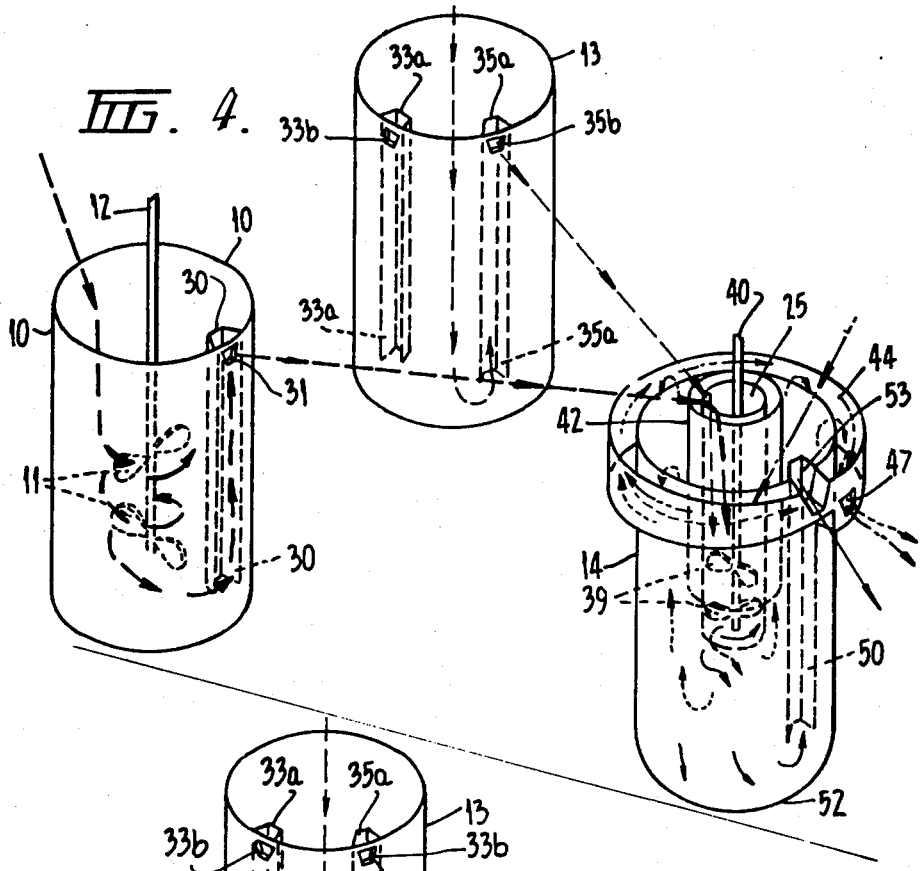
FIG. 4 is a schematic perspective view showing one method of operating the process and apparatus of this invention (referred to herein as "Mode 1").
Figure 6:
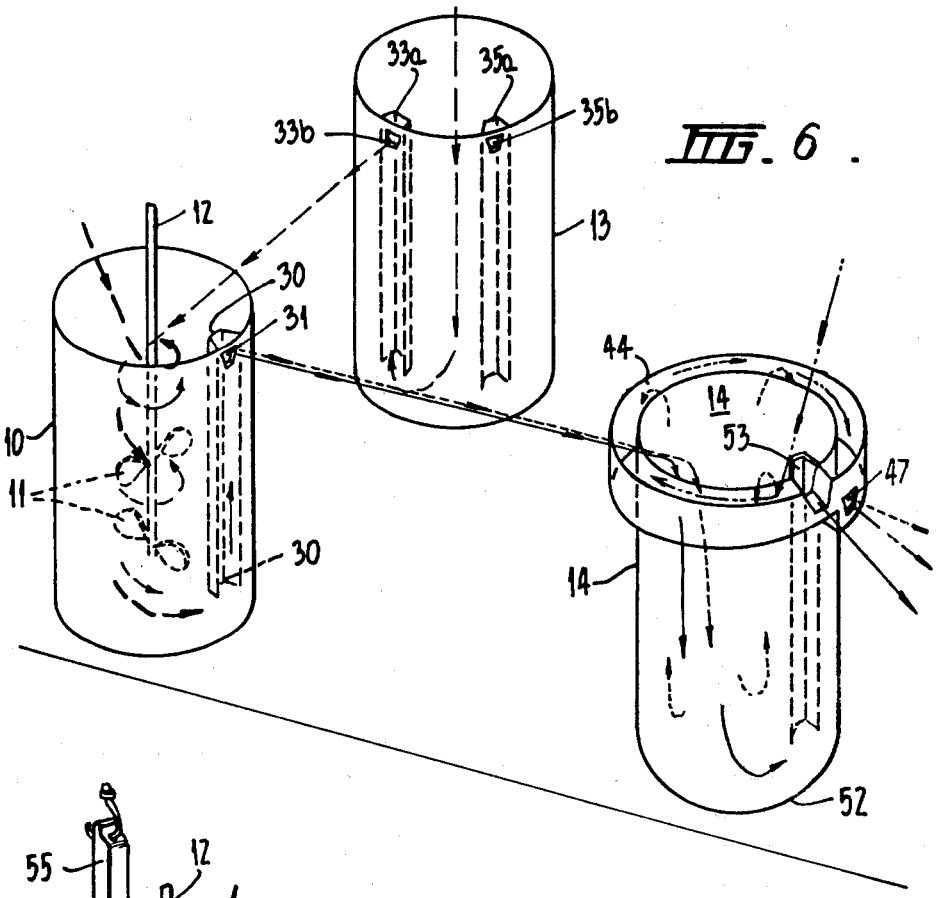
FIG. 6 is a schematic view similar to FIG. 4 showing a further method of operating the process and apparatus of this invention, using a liquid reagent feed (referred to herein as "Mode 3")
Figure 5:
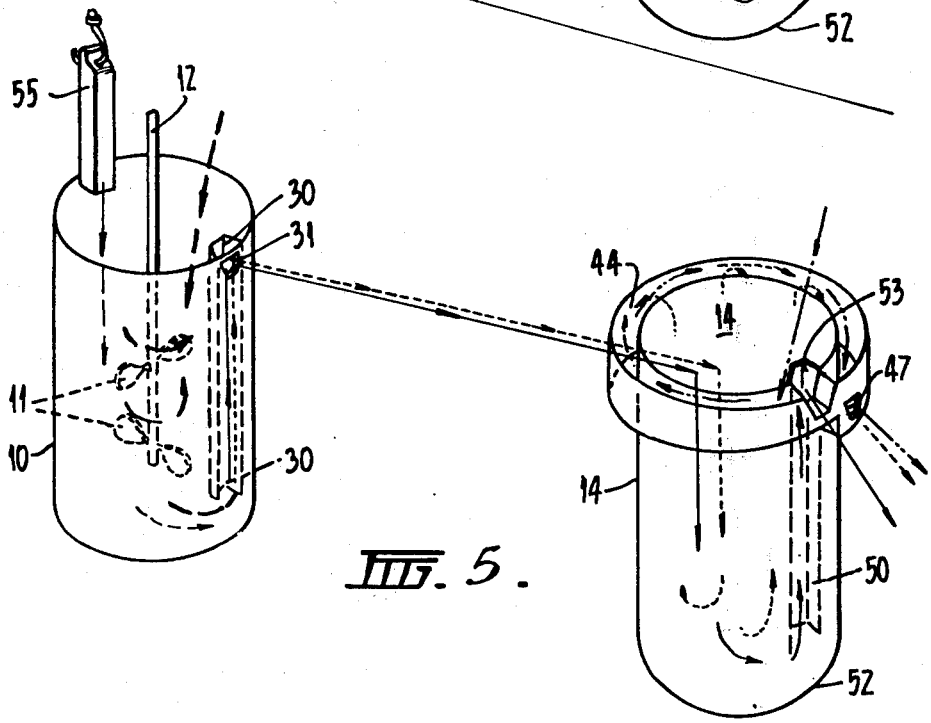
FIG. 5 is a schematic view similar to FIG. 4 showing another method of operating the process and apparatus of this invention, using a solid reagent feed (referred to herein as "Mode 2").

The apparatus shown in FIGS. 1, 2 and 3 can be used to carry out any of the modes of operation of the process of this invention which are illustrated schematically in FIG. 4 (Mode 1), FIG. 5 (Mode 2), FIG. 6 (Mode 3) and FIG. 7 (Mode 4).

In FIGS. 4 to 7 of the drawings, the flow of impure bismuth-containing lead to be debismuthised is shown in thick broken lines, the flow of reagent is shown in thin broken lines, the flow of crusts is shown in dotted lines, the flow of bullion used to assist the flow of crust is shown in dot-dash lines, and the flow of treated or product lead is shown in thin full lines.

The operation of the process will now be described for Mode 1, referring to FIGS. 1 to 3 and FIG. 4.

Lead which contains an alkaline earth metal or metals or alloy thereof, e.g. lead which has previously been subjected to the Kroll-Betterton process, and lacking any further treatment, contains residual quantities of alkaline earth metals and bismuth, is fed continuously by feed pipe 20 and launder 22 to the cylindrical pot 10. In Mode 1, the purpose of this pot 10 is primarily for the adjustment of the temperature.

The passage of the impure lead is shown in FIG. 4 by thick broken lines. The lead passes downward through the pot 10, beneath a submerged weir 30, through the triangular notch 31 and is conveyed by launder 32 and launder 22 to the kettle 14.

The reagent (e.g. pure antimony, antimonial lead, antimony-arsenic alloy, or a lead-antimony-arsenic alloy) is melted in the cylindrical pot 13 and added continuously in molten form via launder 35 to the stream of bullion entering the kettle 14. The flow is controlled to provide the quantity of reagent estimated to give the required degree of debismuthising. The direction of flow of reagent is shown in FIG. 4 by thin broken Lead from pot 10 and reagent from pot 13 flow via launder 22 and thence through pipe 23 into the mixing chamber 25. The input materials and the contents of the mixing chamber 25 should be at a temperature as near the freezing point of the lead as is practicable. Mixing is carried out by the double bladed stirrer 39. Residence time within the mixing chamber 25 is preferably about 15 minutes.

The crust/bullion mixture issues from the bottom of the mixing chamber 25 into the kettle 14. The crust particles containing antimony, and/or arsenic, bismuth, calcium, and magnesium, being of lower specific gravity than lead, separate upwards from the lead, while the lead, now substantially freed of bismuth, slowly passes to the bottom of the kettle 14. The refined lead then passes beneath submerged weir 51, upwards through the side mounted siphon 50 and out of the kettle 14 through the variable height notch 53. Passage of the refined lead product is indicated in FIG. 4 by a solid thin line.

The lower part **14*b* of the kettle 14** thus acts as a separating zone for the removal of crust particles from the product lead. The temperature of this zone is held as near the freezing point of lead as is practicable, so as to prevent or substantially prevent re-solution of bismuth-containing crust particles in the lead.

The separated crust particles pass upwardly through the upper or liquation zone **14*a* of the kettle 14. The temperature of this zone 14*a* is preferably elevated above that of the separation zone 14*b*, so as to facilitate the liquation or separation of the solid and liquid phases. A temperature of 370° to 410° C (preferably about 380° ) has been found practical without any noticeable contamination of the product lead by elements dissolved or entrained in the liquated lead. By suitable adjustment of the height of the outlet notch 53, the upper surface of the crust layer can be made to rise above the upper lip 14*c* of the kettle 14. The enriched crust has a soft, grease-like consistency, unlike the mushy liquid crusts observed in the conventional batch process, and normally will not overflow of its own accord into the collecting channel 44. The enriched crust is therefore transferred, either manually or mechanically, into this channel 44. The flow of crust is indicated by the dotted line in FIG. 4.**

Within the channel 44, the crusts fall into a stream of lead (indicated by dot-and-dash lines in FIG. 4) running circumferentially from the inlet point 46 to the outlet notch 47. The temperature of this lead is preferably in the range 400° to 450° C and is such as to maintain the crusts in a sufficiently plastic condition that they flow readily along the channel 44 and out through notch 47.

By means of channel 48, the lead/crust stream is conveyed to a pan (not shown), where the crusts are treated to provide a dross containing calcium, magnesium and possibly antimony, and a lead bullion containing the bismuth and the balance of the antimony. The lead bullion is then pumped back to point 46 by means of pipe 49 as the conveying lead stream. From time to time bullion is extracted from the system to allow removal of antimony and bismuth from the process. The path of this bullion stream is indicated by dot-dash lines in FIG. 4.

It is important that the enriched crusts be removed at a rate such that the solids do not accumulate in the separation zone **14*b* of kettle 14 to avoid entrainment of crust particles in the outlet lead stream. This becomes a matter of skill in judging the consistency of the crust layer and adjusting the height of the overflow weir 53.**

The refined bullion from the process proceeds to a further process for removal of residual calcium and magnesium as is conventional in the Kroll-Betterton process.

In the form of the invention shown in FIG. 5 (Mode 2), bullion containing an alkaline earth metal or metals or an alloy thereof, e.g. bullion which has been previously treated by the Kroll-Betterton process passes to cylindrical pot 10 which in this mode of operation of the process fulfills the functions both of temperature adjustment and of mixing of the reagent with the bullion. The reagent is added as a solid material as illustrated in FIG. 5, where an ingot 55 is lowered into the bath at a controlled rate. Residence time within the mixing vessel 10 is preferably a minimum of 15 minutes. No upper limit to residence time has been determined, and residence periods of up to three hours have been used with no noticeable ill-effect on process performance. Temperature within the pot 10 should be maintained as near the freezing point of lead as practicable. Stirring should be adequate to maintain all crust particles in suspension.

The crust/bullion mixture passes under submerged weir 30 and out through notch 31 along channel 32 to the separation kettle 14.

The kettle 14 is as described for Mode 1, with the important exception that in Mode 2 of operation there is no necessity for the mixing chamber 25. The crust/bullion mixture is injected horizontally into the kettle 14 at a point intermediate between its upper and lower ends, preferably at about its mid-point. Separation takes place as in Mode 1. Bullion passes slowly downwards, under weir 51, upwards through siphon 50 and over variable height notch 53. The crust particles rise upwards, are liquated (i.e. entrained lead is separated therefrom), and the enriched crusts are transferred into channel 44 as required and conveyed by a lead stream to the crust treatment process via outlet 47 and channel 48. The temperature of the separation zone **14*b* is maintained as near freezing point as is practicable, and the liquation zone 14*a*** is heated to about 370° to 410° C (preferably about 380° C) to facilitate liquation of the lead.

In Mode 3 of the invention, illustrated in FIG. 6, the operation of the process is as described for Mode 2 with reference to FIG. 5 except that a stream of liquid reagent (other than arsenic) is used instead of solid reagent. This is achieved by melting the reagent in pot 13 and feeding the liquid reagent to the pot 10 via launder 33 at a controlled rate where it is mixed with the bullion therein. The crust/bullion mixture formed in pot 10 is transferred to the kettle 14 and the treatment therein is as described with reference to Mode 2 (FIG. 5).

In Mode 4 of the invention, illustrated in FIG. 7, the kettle 14 is as in Mode 1 (FIG. 4), bullion is admitted directly to the mixing chamber 25, to which is also added the reagent by the same method as in Mode 1. The lead stream should be admitted at as low a temperature as is practicable, and preferably below 340° C. The treatment which takes place in the kettle 14 is as described above with reference to Mode 1 (FIG. 4).

Examples of the operation of the invention will now be described:

EXAMPLE 1

Lead bullion containing 0.01% Bi, 0.053% Ca, 0.16% Mg, which had been previously treated by the K-B process, was treated by the process of this invention according to Mode 2 (FIG. 5). The reagent used was a solid antimonial lead alloy containing 6% Sb and the said alloy was added at the rate of 0.15% Sb to bullion by weight and at a bullion temperature of 340° C. The temperature of the lower separation zone was 340° C and the temperature of the upper liquation zone was 375° C. The product lead withdrawn from the lower separation zone contained 0.00094% Bi, 0.027% Ca, 0.11% Mg, <0.0002% Sb. The enriched crust removed from the upper surface of the bullion in the upper liquation zone contained 0.08% Bi, 0.12% Ca, 0.49% Mg, 1.7% Sb. The yield of enriched crust was 9.4% of the product lead by weight, i.e. 8.8% of the input bullion by weight.

It was calculated that over 99.8% of the crust particles were separated from the crust/bullion mixture, and that over 91.8% of the total lead input (as bullion and reagent alloy) was recovered as product lead, these percentages being by weight.

EXAMPLE 2

Lead bullion containing 0.014% Bi, 0.039% Ca, 0.14 Mg, which had been previously treated by the K-B process, was treated by the process of this invention according to Mode 3 (FIG. 6). The reagent was in molten form and was an antimonial lead alloy containing 6% Sb, and was added at the rate of 0.10% Sb to bullion by weight, and at a bullion temperature of 340° C. The temperature of the lower separation zone was 345° C and the temperature of the upper liquation zone was 380° C.

The product lead withdrawn from the lower separation zone contained 0.0043% Bi, 0.028% Ca, 0.11% Mg, <0.0002% Sb. The enriched crust removed from the upper surface of the bullion in the liquation zone contained 0.18% Bi, 0.22% Ca, 0.59% Mg, 1,9% Sb. The yield of enriched crust was 5.3% of the input bullion by weight and was 5.5% of the product lead by weight.

It was calculated that over 99.9% of the crust particles were removed from the crust/bullion mixture, and that over 95% of the total lead input (as bullion and reagent alloy) was recovered as product lead, the percentages being by weight.

EXAMPLE 3

Lead bullion containing 0.016% Bi, 0.043% Ca, 0.15% Mg, which had been previously treated by the K-B process, was treated by the process of this invention according to Mode 2 (FIG. 5). The reagent used was an antimonial-arsenic lead alloy in solid form containing 5% Sb, and 0.5% As, and was added at the rate of 0.15% Sb and 0.015% As to the bullion, by weight. The temperature of the lower separation zone was 340° C and the temperature of the upper liquation zone was 390° C. The product lead withdrawn from the lower separation zone contained 0.0040% Bi, 0.019% Ca, 0.087% Mg, <0.0002% Sb. The enriched crust removed from the upper surface of the bullion in the upper liquation zone contained 0.13% Bi, 0.23% Ca, 0.51% Mg, 1.8% Sb. The crust yield was 8.9% of the product lead by weight.

It was calculated that over 99.8% of the crust particles were removed from the crust/bullion mixture, and that over 91.6% of the input lead (as bullion and reagent alloy) was recovered; the percentages being by weight.

EXAMPLE 4

Lead bullion containing 0.012% Bi, 0.040% Ca, 0.16% Mg, which had previously been treated by the K-B process, was treated by the process of this invention according to Mode 2 (FIG. 5). The reagent used was solid antimony which was added at the rate of 0.05% Sb to bullion by weight, and at a bullion temperature of 350° C. The temperature of the lower separation zone was 335° C. and the temperature of the upper liquation zone was 425° C.

The product lead withdrawn from the lower separation zone contained 0.0051% Bi, 0.034% Ca, 0.14% Mg, <0.0002% Sb. The enriched crust removed from the upper surface of the bullion in the liquation zone contained 0.12% Bi, 0.21% Ca, 0.47% Mg 1.7% Sb. The crust yield was 2.9% of the product lead by weight.

It was calculated that over 99.9% of the crust particles were removed from the crust/bullion mixture, and that over 97.2% of the input lead was recovered as product lead; these percentages being by weight.

We claim:

1. A continuous process for debismuthising lead containing one or more alkaline earth metals or alloys thereof, which comprises continuously adding thereto a reagent selected from the group consisting of antimony, arsenic and alloys containing antimony and/or arsenic, so as to form a crust/bullion mixture, continuously introducing the crust/bullion mixture into the lower separation zone of a separation vessel having an upper liquation zone and a lower separation zone, maintaining the temperature in the upper liquation zone between 330° and 480° C and maintaining the temperature in the lower separation zone between the freezing point of lead and 350° C, the average temperature in the upper liquation zone being at least 15° C higher than the average temperature in the lower separation zone, separating crust particles from the bullion in the lower separation zone, causing the crust particles to move upwardly in the vessel and the bullion to move downwardly in the vessel, separating entrained lead from the crust particles in the upper liquation zone so as to form enriched crusts, removing the enriched crusts continuously or intermittently from the upper surface of the material in the vessel, and withdrawing debismuthised product lead continuously from at or near the lower end of the lower separation zone.

2. A process according to claim 1 wherein the quantity of enriched crusts removed from the vessel is less than 15% of that of the product lead by weight.

3. A process according to claim 1 wherein the downward velocity of the lead in the lower separation zone of the separation vessel is below that at which crust particles would be entrained in the downflowing lead in said zone.

4. A process according to claim 3 wherein the downward velocity of the lead in the lower separation zone is less than 1 meter per minute.

5. A process according to claim 3 wherein the downward velocity of the lead in the lower separation zone is less than 0.5 meters per minute.

6. A process according to claim 1 wherein the temperature of the upper liquation zone and that of the lower separation zone are controlled independently.

7. A process according to claim 1 wherein the temperature in the lower separation zone is sufficiently low to substantially prevent re-solution to the bismuthcontaining crust particles in the bullion, and the temperature in the upper liquation zone is sufficiently high to ensure separation of entrained lead from the crust particles passing upwardly through said zone.

8. A process according to claim 1 wherein the ratio of depth to diameter of the lower separation zone is not less than 1:1.

9. A process according to claim 1 wherein the temperature in the lower separation zone is below 340° C.

10. A process according to claim 1 wherein the depth of the upper liquation zone is at least 0.1 meter.

11. A process according to claim 1 wherein the temperature in the upper liquation zone is between 370° and 410° C.

12. A process according to claim 1 wherein at least 95% by weight of the crust particles present in the crust/bullion mixture are separated therefrom in the lower separation zone.

13. A process according to claim 1 wherein at least 85% by weight of the total input lead is recovered as product lead.

14. A process according to claim 1 wherein the input lead has been previously treated by the Kroll-Betterton process as hereinbefore defined.

15. A process according to claim 1 wherein the alkaline earth metals present in the input lead are calcium and magnesium.

16. A process according to claim 1 wherein the reagent added is antimony or an alloy thereof.

17. A process according to claim 1 wherein the reagent added is arsenic or an alloy thereof.

18. A process according to claim 1 wherein the reagent and the input lead are introduced into a mixing chamber located within the separation vessel, and the crust/bullion mixture formed in the mixing chamber is passed from the lower end of the mixing chamber into the lower separation zone of the said vessel.

19. A process according to claim 18 wherein the mixing chamber is open at its upper and lower ends and extends from near the upper end of the separation vessel to about its mid-point.

20. A process according to claim 18 wherein the mixing chamber is insulated from the contents of the vessel and is maintained at substantially the same temperature as that of the lower separation zone.

* * * * *